US006948540B2

(12) United States Patent
Brignell et al.

(10) Patent No.: US 6,948,540 B2
(45) Date of Patent: Sep. 27, 2005

(54) ENVELOPE SEALING APPARATUS

(75) Inventors: Graham J. Brignell, Suffolk (GB); Christopher J. Brown, Hertfordshire (GB); Geoffrey A. Farmer, Essex (GB)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/387,072

(22) Filed: Mar. 12, 2003

(65) Prior Publication Data

US 2004/0035528 A1 Feb. 26, 2004

(30) Foreign Application Priority Data

Mar. 13, 2002 (GB) ..... 02 05941

(51) Int. Cl.[7] ..... B43M 3/04

(52) U.S. Cl. ..... 156/360; 156/364; 156/363; 156/362; 156/442.1; 156/442.3; 156/442.2

(58) Field of Search ..... 156/360, 362, 156/363, 364, 578, 308.8, 308.6, 442.1, 441.5, 442.2, 442.3, 368, 367, 366

(56) References Cited

U.S. PATENT DOCUMENTS 5,026,035 A * 6/1991 Martinez Sanz et al. ..... 270/45

* cited by examiner

*Primary Examiner*—George Koch
(74) *Attorney, Agent, or Firm*—Steven J. Shapiro; Angelo N. Chaclas

(57) ABSTRACT

Disclosed herein is an envelope sealing apparatus, preferably for use in an inserter (210), for sealing a stuffed envelope having a moisture activated adhesive on its flap. Includes a moistener (30) for wetting the moisture-activated adhesive, a sealer (252) for applying the envelope flap to the stuffed envelope body to seal the same and a control system for arresting the moistened envelope for an adjustable dwell time before the sealing operation. The dwell time is adjusted according to the number of inserts/documents in the envelope or according to the thickness of the contents.

6 Claims, 14 Drawing Sheets

ENVELOPE SEALING APPARATUS

BACKGROUND OF THE INVENTION

The present invention relates to apparatus and methods for sealing envelopes and may form part of apparatus for inserting documents into envelopes.

Envelope inserting apparatus is well known and involves inserting paper documents into a waiting envelope that has had its front and rear panels spread apart to receive the insert material. In the inserting station, the envelope arrives first and is typically opened by a combination of devices which may include bending rolls and hold-down fingers. The contents to be inserted then arrive through a second path and are driven into the envelope. Typically, the last part of the inserting motion is accomplished ballistically for about 0.5° to 0.8° using the kinetic energy of the inserts. Reliability problems exist with this system because the envelope does not always open sufficiently, and, due to the bent nature of the envelope, drag is created on the insert material preventing it from reaching the bottom of the envelope.

Apparatus which positively opens the envelope and holds the envelope open, thereby greatly reducing the amount of drag on the insert material and assuring that the insert material is reliably inserted into the waiting envelope, is known from the present applicants' European Patent Application 0 785 092A. In this apparatus, a waiting envelope is supported in a substantially horizontal plane with its back panel situated above its front panel and the envelope flap in its open position and substantially in the plane of the front panel. A pair of hold-down fingers presses the envelope flap from above against the inboard ends of respective pivotable paddles having an interior leg and an exterior leg angled out of the plane of the interior leg, to cause the flap to be bowed downwardly. This causes the rear panel to "pop" upwardly, thereby opening the envelope ready for an insert or insert collation to be inserted.

A succession of documents is fed, collated, optionally stapled, folded, and then inserted into the waiting envelope. The stuffed envelope is then moistened along its gummed flap, and sealed at a sealing station. However, as the number of inserts increases, there is an increasing tendency for the sealed envelope to burst open again. This places a constraint on the number of possible inserts.

It is an aim of the present invention to provide an envelope sealing apparatus whose operation is improved in this respect.

SUMMARY OF THE INVENTION

According to one aspect of the invention, there is provided envelope sealing apparatus for sealing a stuffed envelope having a moisture-activated adhesive on its flap, including a moistener for wetting the moisture-activated adhesive on the envelope flap, a sealer for applying the envelope flap to the stuffed envelope body to seal the same and a control system for arresting the moistened envelope for a dwell time before the sealing operation, and for adjusting the dwell time according to the number of inserts in the envelope or the thickness of the envelope contents.

According to another aspect of the invention, there is provided a method of sealing a stuffed envelope having a moisture-activated adhesive on its flap, including the steps of: wetting the moisture-activated adhesive on the envelope flap; adjusting a dwell time according to the number of inserts in the envelope or the thickness of the envelope contents; arresting the moistened envelope for a dwell time before sealing; and sealing the envelope flap onto the stuffed envelope body.

The dwell time has to be adjusted according to the thickness of the envelope contents. This could of course be achieved by direct measurement of the thickness by means of a thickness measuring device, known per se. However, it is preferred to adjust the dwell time according to the number of documents or sheets inserted into the envelope, which provides a sufficiently accurate measure of thickness.

In the described embodiment, the envelope is arrested after moistening and after the flap is closed, but before the adhesive of the flap passes through the sealing rollers. It would alternatively be possible, and effective, to arrest the envelope after moistening, but before the flap is closed.

For a better understanding of the invention and to show how the same may be carried into effect, reference will now be made, by way of example, to the accompanying drawings, in which.

DETAILED DESCRIPTION OF THE INVENTION

Figure 1:
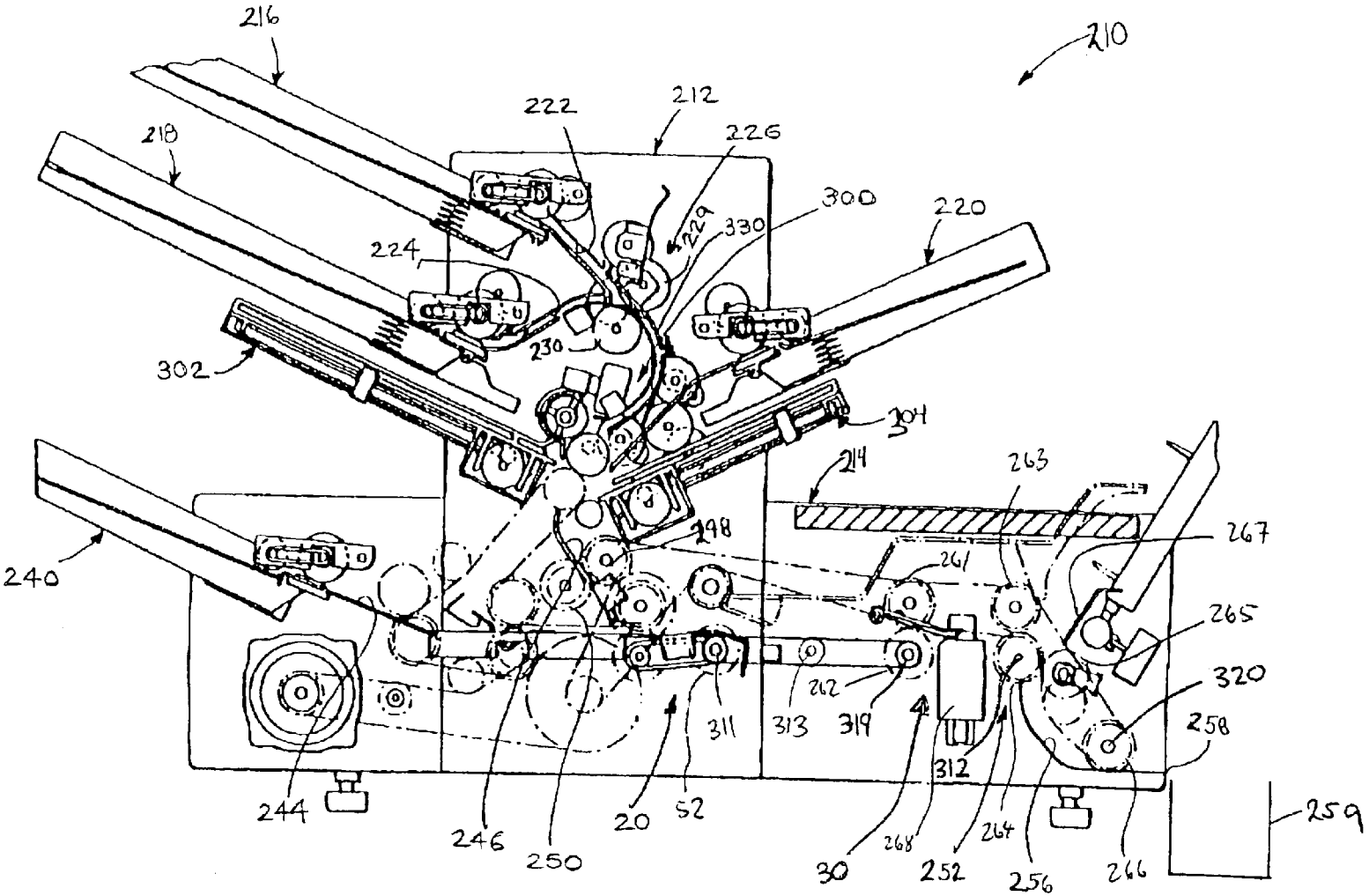
FIG. 1 is an elevational view of a document inserting system incorporating an envelope sealing apparatus forming an embodiment of the present invention.
Figure 2:
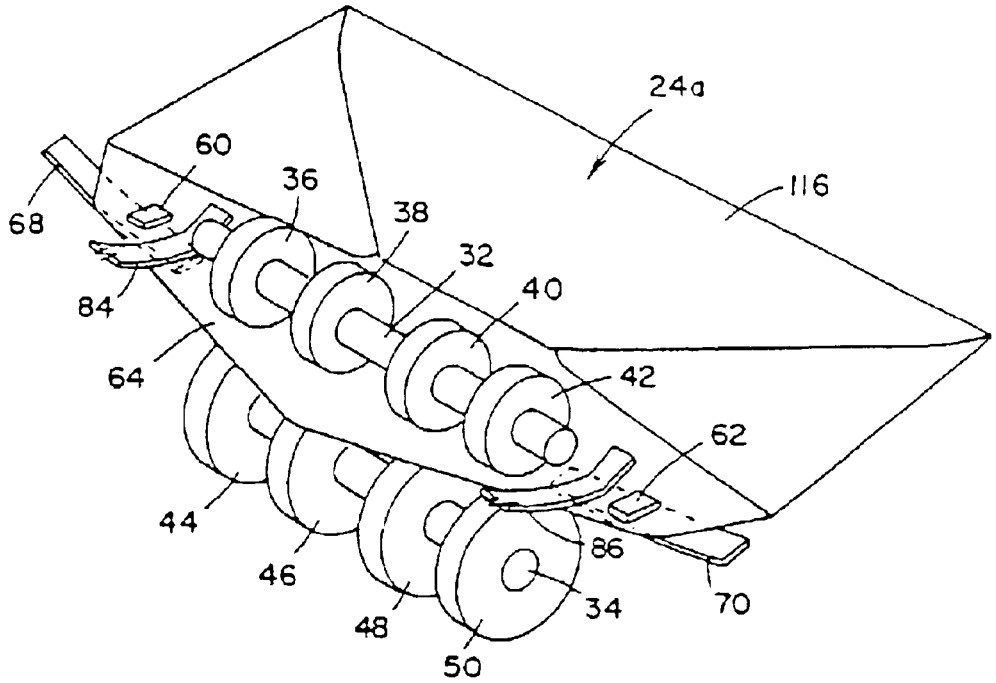
FIG. 2 is a perspective view of the envelope opening apparatus showing opening horns about to enter the envelope.
Figure 3:
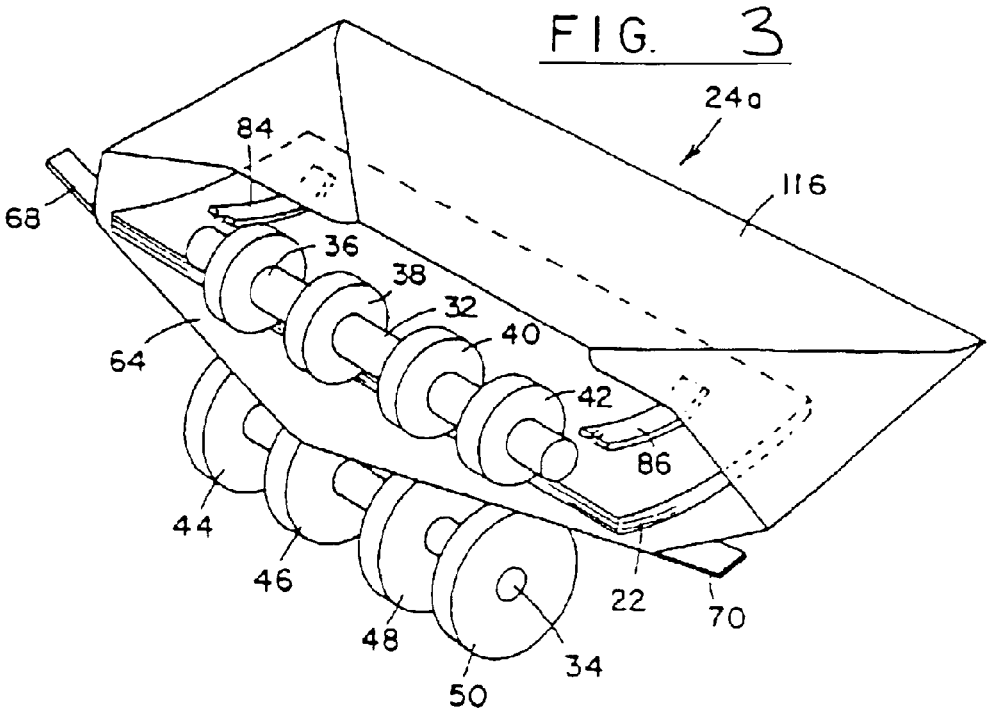
FIG. 3 is similar to FIG. 2 but shows the opening horns fully engaging the envelope and enclosure documents being inserted into the envelope.

Reference is made to the drawings, wherein there is seen in FIG. 1 an elevational view of a tabletop inserter, designated generally at 210, incorporating an envelope sealing apparatus forming an embodiment of the invention and located at moistening station 30 and sealing station 252. It is to be appreciated that reference is made to the inserter system 210 of FIG. 1 only to show an exemplary environment of implementation for this envelope sealing apparatus. Thus, inserter system 210 is not to be understood to be the only environment for use for the envelope sealing apparatus as one skilled in the art could readily implement the below described envelope sealing apparatus in various inserter systems requiring an envelope sealing apparatus or in any mechanism requiring an apparatus for sealing envelopes. Therefore, in order not to obscure the description of the envelope sealing apparatus, only a simplified description of the inserter system 210 depicted in FIG. 1 will be provided. For a more detailed description, reference is made to European Patent Application-0 700 794A assigned to the present applicants.

With reference to FIG. 1, tabletop inserter 210 generally consists of an upper housing 212 mounted atop a lower housing 214. Upper housing 212 generally includes first and second sheet feeders 216 and 218, and preferably an insert feeder 220. Individual sheets are preferably conveyed from each sheet feeder 216 and 218 into respectively first and second feed paths 222 and 224. The first and second sheet paths 222 and 224 merge with one another at a collation station 226 having first and second collating rollers 229 and 230. The collating station 226 is operative to align the leading edges of first and second sheets being respectively conveyed from the first and second sheets feeders 216 and 218, via the first and second sheet paths 222 and 224, within the nip formed between the collating rollers 228 and 230. Once aligned, the collating rollers 228 and 229 are actuated to simultaneously feed the aligned sheets in a supply path 330 downstream of the collating station 226. These aligned sheets are also known as a "collation". This sheet collation is then conveyed downstream in the supply path 330 to the folding station 300.

The folding station is configured to fold the sheet collation in prescribed configurations, such as C-fold, Z-fold, Half-fold, Double-fold etc. In this constructional example, the folding station 300 comprises a first removable fold plate 302 and a second removable fold plate 304. It also includes a diverter which is operable for diverting a sheet approaching the first fold plate 302 directly to the second fold plate 304. Depending on the setting of the diverter, the type of fold that is made can be selected. After a collation is folded in the folding station 300, the folded collation is then conveyed to the lower housing 214 of the inserter system 210 for further processing. Of course, the inserter may also be operated to feed a single document from feeder 216 or 218, fold it and advance it singly to the lower housing 214.

The lower housing 214 of inserter system 210 includes an envelope supply station 240 connecting to insertion station 20. Located at the insertion station is the envelope opening apparatus to be described in detail below. The envelope supply station 240 feeds closed envelopes to the insertion station 20, via envelope feed path 244. Once received in the insertion station 20 an envelope is opened in preparation for insertion of the aforesaid folded collation or single document being conveyed from the folding station 300. Thus, the folded collation or document is transported from the folding station 300 to the insertion station 20, via a transport path 246 connecting the latter two stations. Preferably the transport path 246 includes a pair of conveying rollers 248 and 250 for conveying a folded collation or document along the transport path 246.

The lower housing 214 further includes a moistening station 30 and a sealing station 252 located downstream of the insertion station 20. The sealing station 252 is operative to seal an open envelope whose flap has been moistened by moistener 30. An envelope transport path connects the insertion station 20 to the sealing station 252 via the moistening station 30. An envelope output path 256 connects to the sealing station 252 and is operative to convey sealed envelopes from the sealing station 252 through an output opening 258 provided in the lower housing 214 of the insertion system 210, and into a bin 259. After a sealed envelope has exited from the output opening 258, appropriate postage can then be applied for delivery to a recipient.

Moistener station 30 comprises an inlet nip formed by rollers 261 and 262 and a liquid reservoir 268 containing water or other suitable moistening liquid for applying moisture to the envelope as it is advanced with flap trailing, adhesive side up, through the nip 261,262. The envelope then passes through the moistener in the form of a brush applying water to the flap adhesive. The leading edge is then seized by rollers 263,264 forming an inlet nip for the sealing station 252. As the envelope advances through nip 263,264 the leading edge passes up ramp 267 and strikes a stop positioned such that the flap is still held by the nip 263,264. The envelope is then driven down between the rollers 264 and 265 forming a sealing nip. When the fold line, now forming the leading edge, is seized by the sealing nip, movement of the rollers 263, 264 and 265 is arrested for an adjustable dwell time to allow the adhesive to be fully wetted or emulsified. To arrest the envelope at this point, the drive to rollers 264 and 265 is interrupted for a dwell time of a few seconds as set by the control system. Drive to the sealing rollers 264 and 265 is then continued, the envelope is compressed by the nip between rollers 264 and 265 and properly sealed. A similar sealing system (without adjustable dwell) is described in U.S. Pat. No. 5,814,183.

Inserter system 210 includes a control system (not shown) for controlling the various components implemented in the inserter system. It is to be appreciated that the control system is to encompass a microprocessor driven system.

With the general structure of inserter system 210 being described above, a more specific description will now be given regarding the insertion station 20 of the preferred embodiment.

Figure 9:
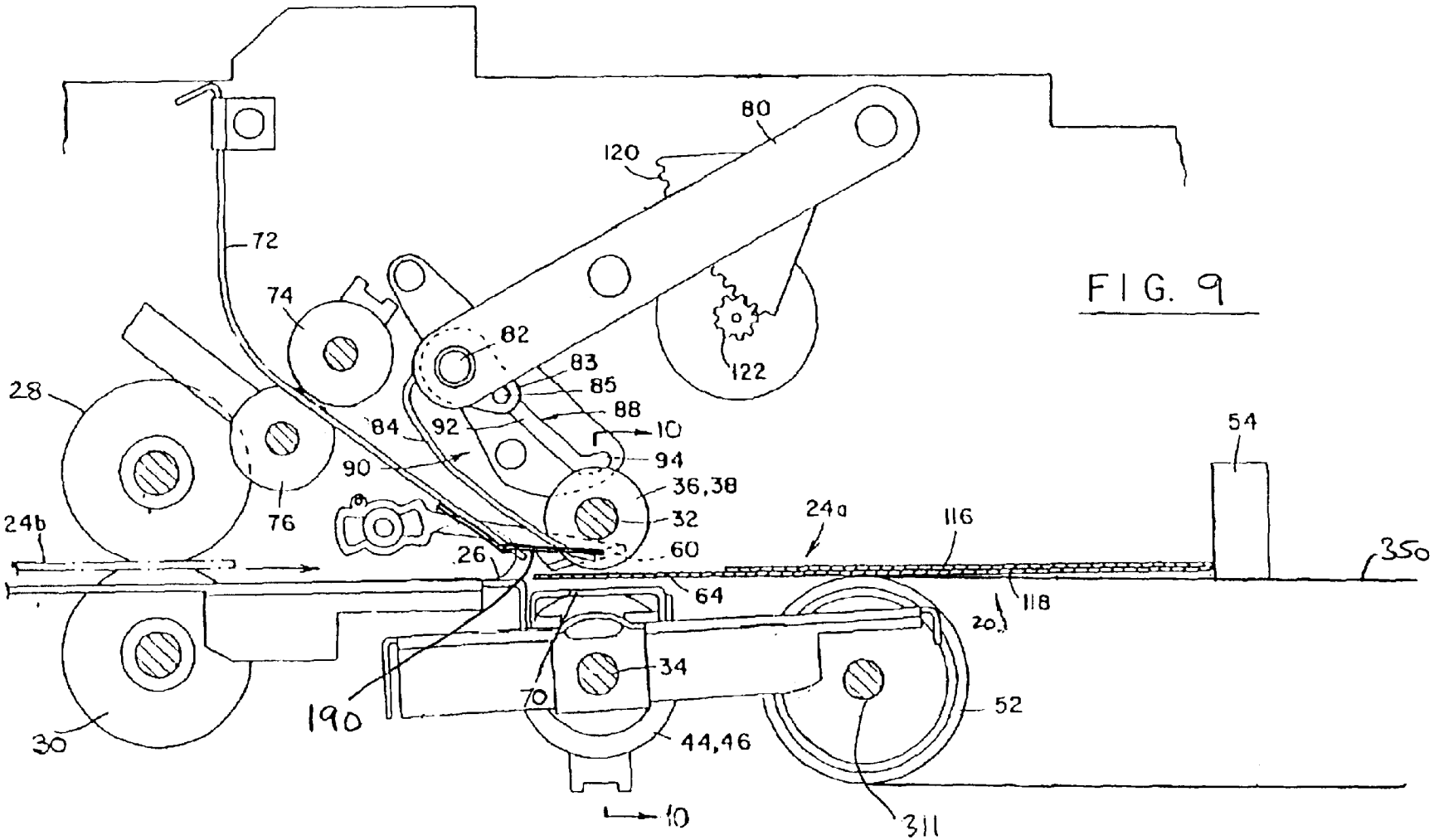
FIG. 9 is a side, elevational view of the inserting apparatus showing an envelope prior to being opened for insertion.

Reference is now made to FIG. 9, which shows the inserting station 20 for inserting paper documents 22 (see FIG. 14) into a waiting envelope 24*a* having its front panel 118 underneath, its back panel 116 uppermost, and its flap 64 open, upwardly facing and in a trailing position. The documents 22 may either be inserted singly, or as a collation. Where multiple documents are inserted singly into a common envelope, special steps are taken to ensure correct insertion, as will be described hereinafter. The inserting station 20 includes a supporting deck 26 and a pair of envelope feed rollers 28 and 30 for feeding an envelope 24*b* to the position occupied by the envelope 24*a*. Downstream of the rollers 28 and 30 are a fixed, upper shaft 32 and a vertically translatable, lower, drive shaft 34. The upper shaft 32 supports four, spaced feed rollers 36, 38, 40 and 42 rotatably secured thereto (see FIGS. 2, 3, 7, 10 and 12) while the lower shaft 34 supports four spaced, cooperating drive rollers 44, 46, 48 and 50 respectively fixedly secured to the drive shaft 34. The shaft 34 is mounted in such manner that the drive rollers 44, 46, 48 and 50 can be raised and lowered selectively.

Figure 5:
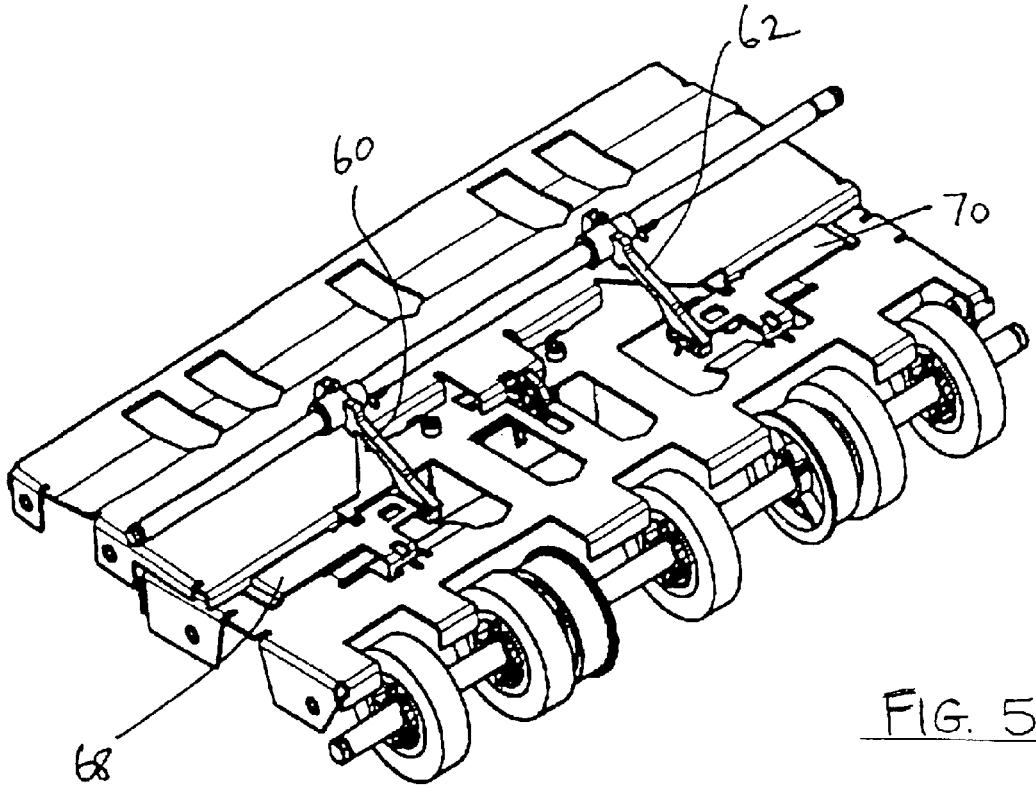
FIG. 5 is a perspective view showing a pair of hold-down fingers associated with a pair of flippers, prior to an envelope being opened.
Figure 6:
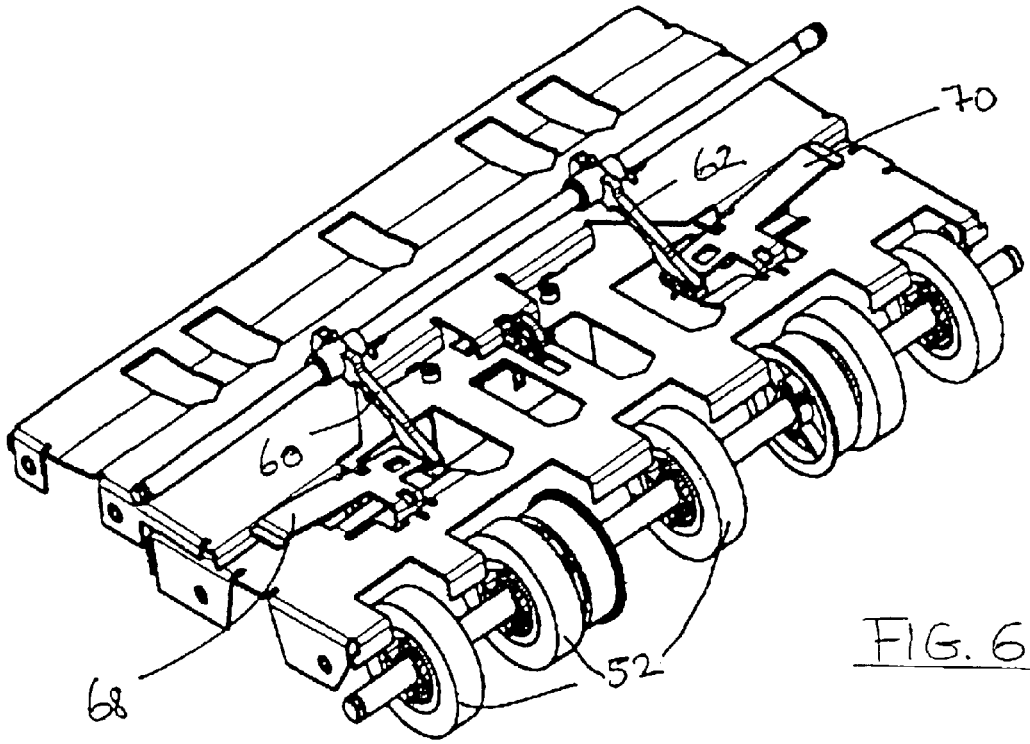
FIG. 6 is a corresponding view to that of FIG. 5 but showing the hold-down fingers in their lower position, for engagement with the envelope flap and for raising the back panel of the envelope.
Figure 7:
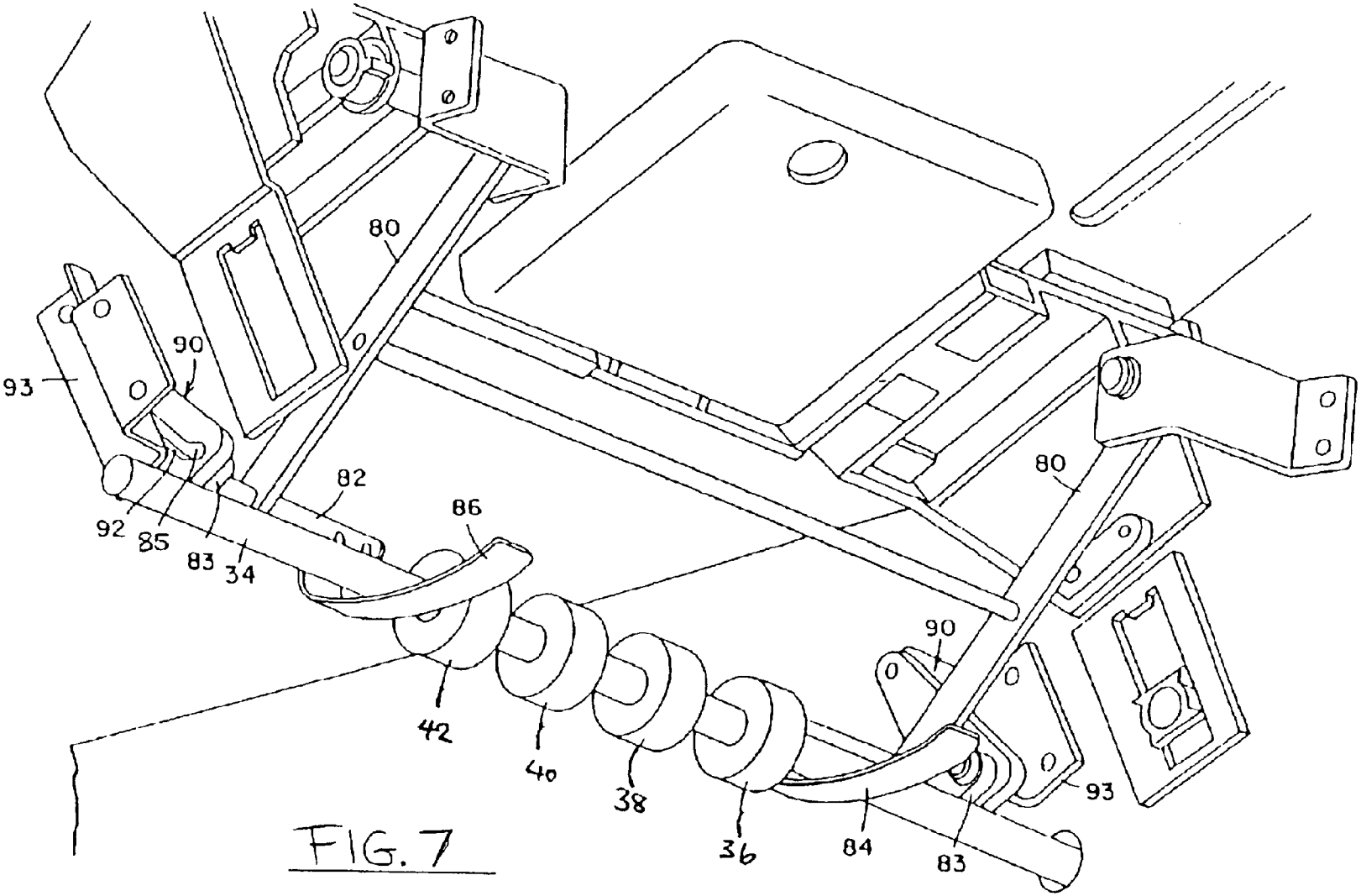
FIG. 7 is a bottom perspective view of the opening horns and associated drive for the horns.
Figure 8:
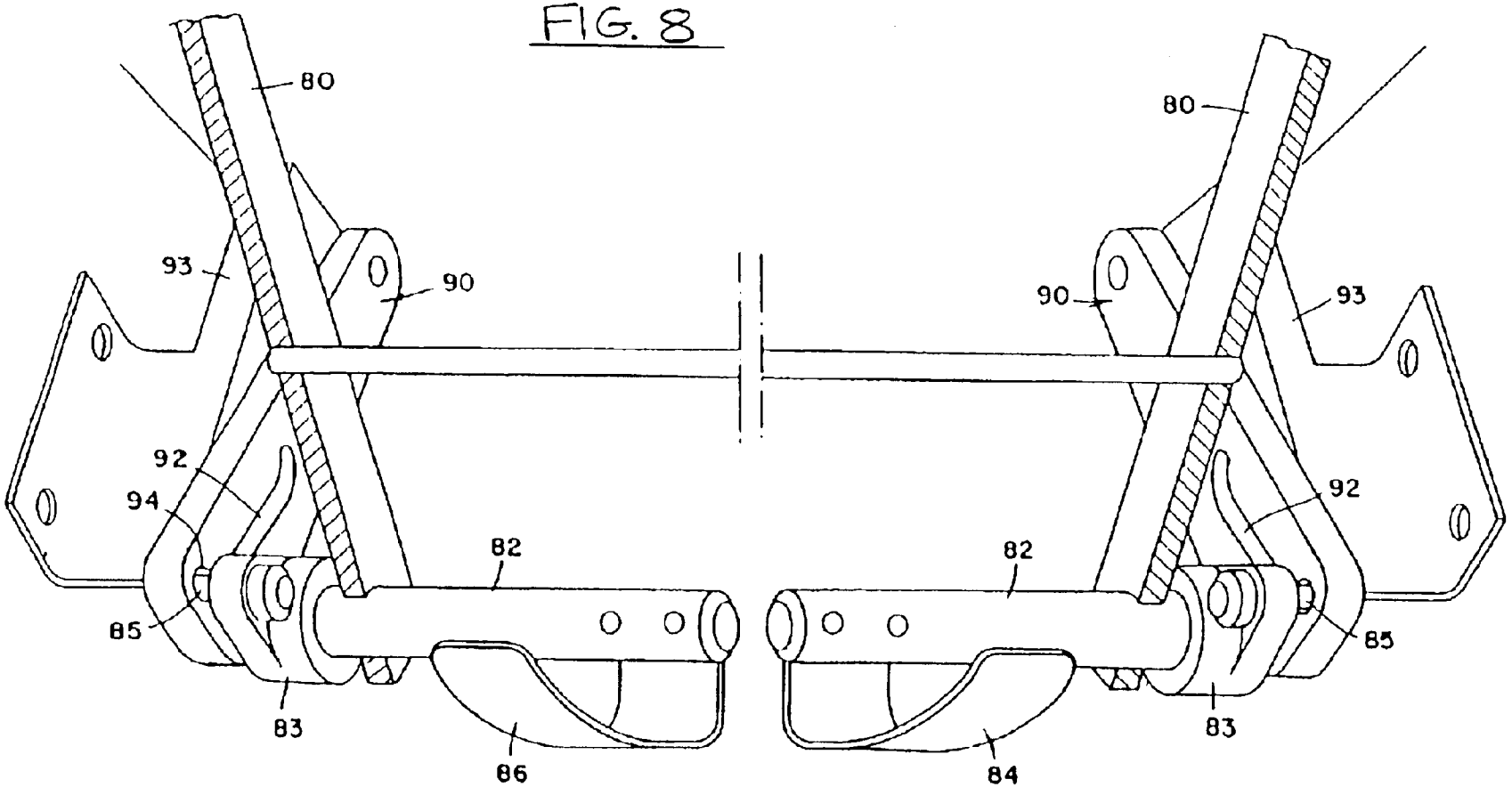
FIG. 8 is a front, perspective view of the opening horns and associated drive apparatus.

Downstream of the shafts 32 and 34 is a bending roll 52 forming part of, and arranged at one end of, a conveyor 350, the roll 52 comprising individual spaced-apart rollers as shown in FIGS. 5 and 6. Further downstream is provided a vertically translatable envelope stop 54.

A pair of pivotable hold-down fingers 60 and 62 (see FIGS. 2, 5 and 9) are situated between the shafts 32 and 34 and above the envelope flap and function, as explained in further detail hereinbelow, to press down on the envelope flap 64 and open the mouth of the envelope. Situated beneath the hold-down fingers 60 and 62 are a pair of flippers 68 and 70 (FIGS. 5 and 9, FIGS. 2 and 3 showing the flippers purely diagrammatically), which cooperate with the fingers 60 and 62 respectively to effect the opening of the mouth of the envelope 24*a* as explained in further detail hereinbelow.

Figure 4:
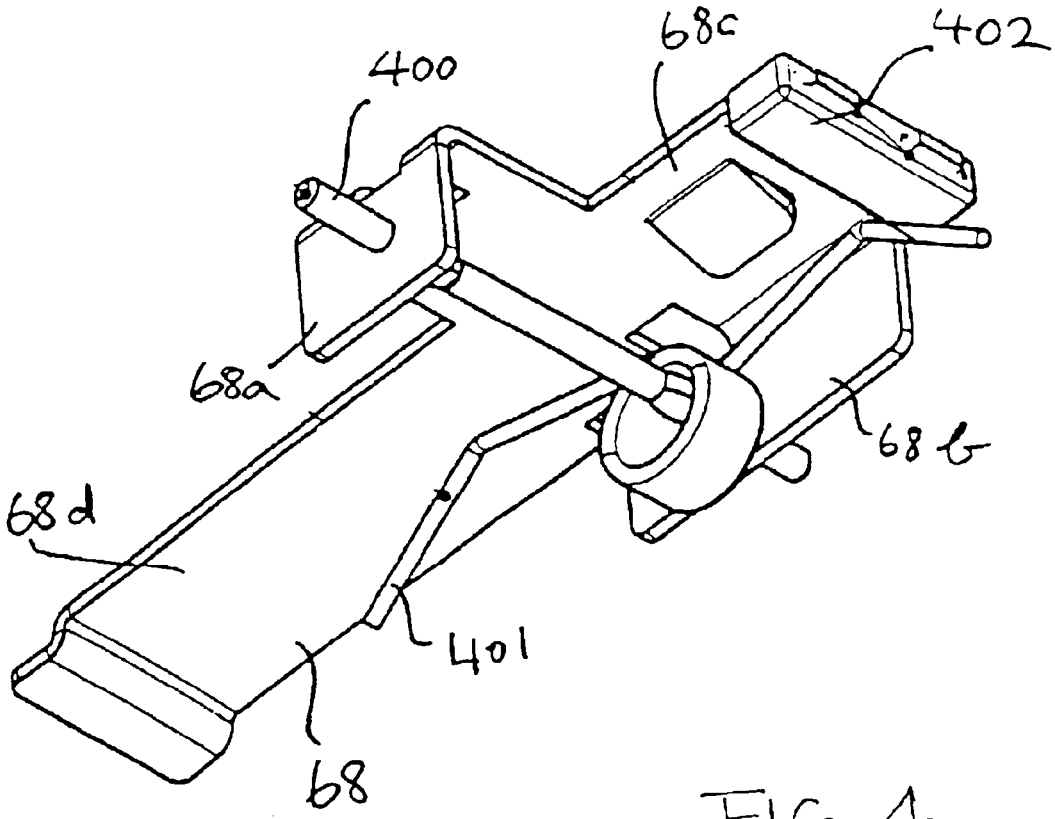
FIG. 4 is a bottom, perspective view of a flipper used in the envelope opening apparatus.
Figure 10:
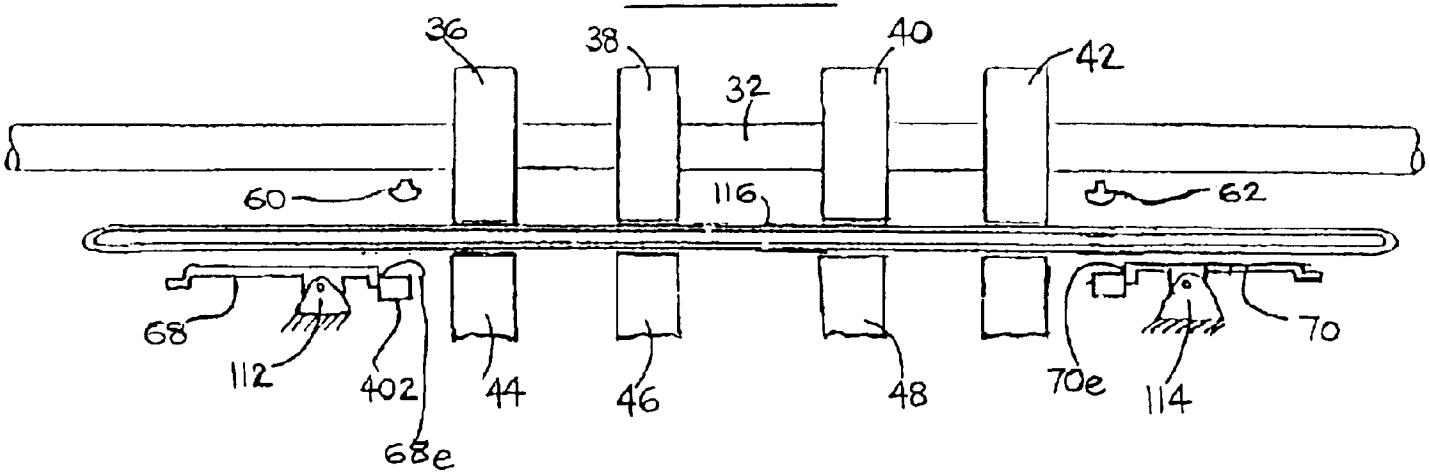
FIG. 10 is a sectional view taken on the plane indicated by the line 10—10 in FIG. 9.
Figure 11:
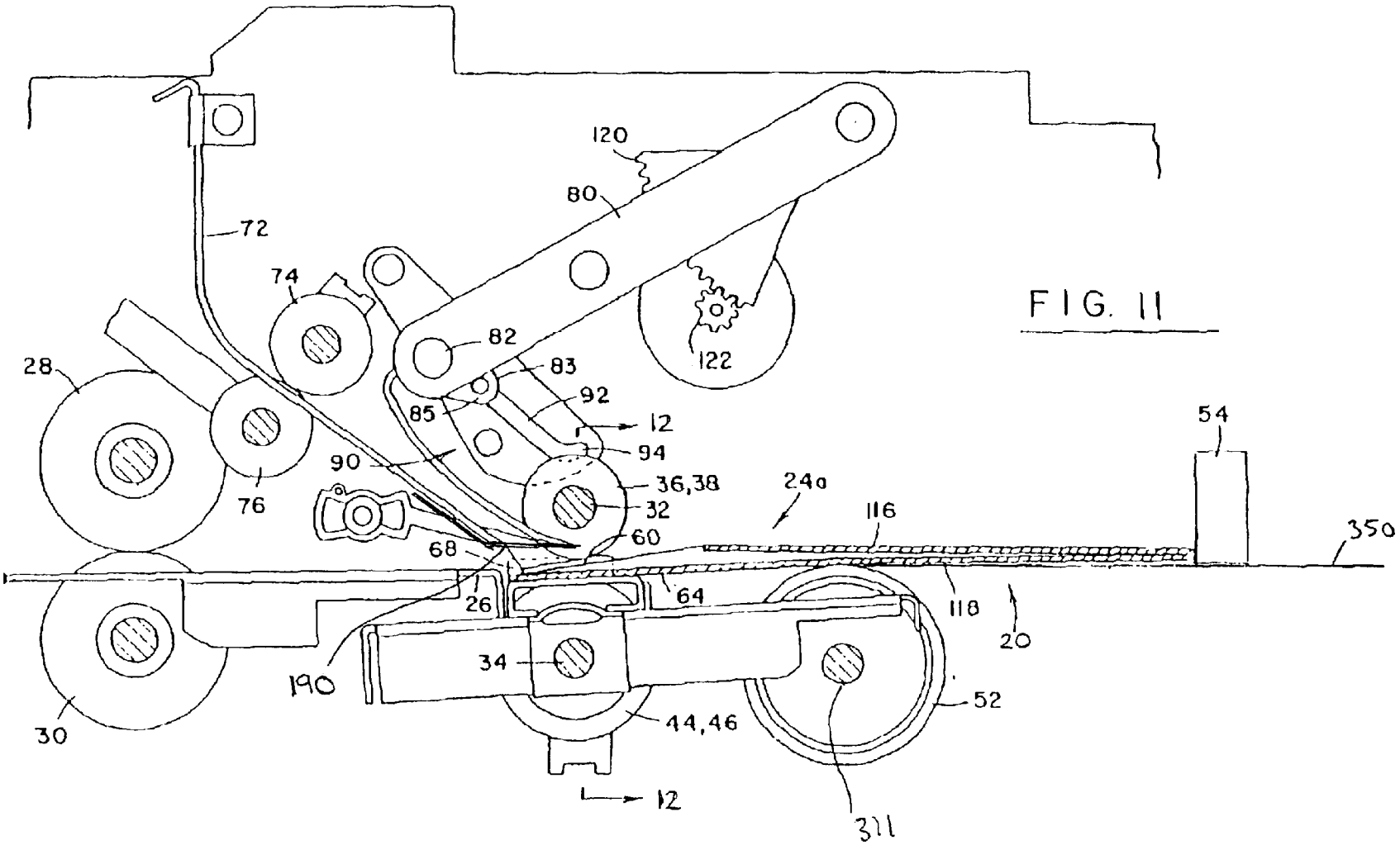
FIG. 11 is similar to FIG. 9 but shows the hold-down fingers rotated to engage the envelope flap and the back panel of the envelope slightly raised.

As best shown in FIG. 4 for flipper 68, each flipper is made from a piece of strip-like metal having a pair of downwardly bent side lugs 68*a*, 68*b*, through which a pivot shaft 400, held in suitable supports 112, 114, (FIG. 10) located slightly inside the outside edges of the envelope and under the envelope flap 64, passes to enable the flipper to pivot about the axis of shaft 400, against the return bias of torsion spring 401, between a normally inoperative position shown in FIGS. 5 and 10 and an operative position shown in FIGS. 6 and 11 in which the envelope throat is opened. The flipper 68 has an inboard leg 68*c* that is located inwardly of the pivot axis of the flipper and an outboard leg 68*d* that is located outwardly of the pivot axis. The inboard leg carries a gripping pad 402 at its inner end whose function is described below. This pad, as shown in FIG. 10, is mounted on an offset angled end portion of the flipper at its inboard end, so that a step 68*e* is formed adjacent the inner end of the inboard leg 68*c*. Preferably, the pad 402 is made of polyurethane. The flipper 70 is correspondingly constructed and its step is shown at 70*e* in FIG. 10.

The paper documents 22 which are to be inserted into the waiting envelope 24*a* are fed by upstream feed apparatus (not shown), such as folding rollers along a chute 72 toward a pair of insert feed rollers 74 and 76 which continue to feed the documents 22 through the opening between the upper rollers 36, 38, 40 and 42 and the lower rollers 44, 46, 48 and 50, which latter are lowered at this time. The momentum given the documents 22 by the feed rollers 36, 38, 40 and 42, due to a leaf spring diagrammatically shown at 290 urging the documents from below against these feed rollers, conveys the documents 22 into the waiting envelope 24*a*.

The insert station 20 further includes a pair of pivotable support arms 80 which rotatably support, at their lower ends, a rotatable shaft 82. A pair of opening horns 84 and 86 are fixedly secured to the laterally extending shaft 82. At the opposite ends of the shaft 82 are a pair of link members 83 each fixedly secured at one end to the shaft 82 and at the other end rotatably secured to a pin 85. Each of the pins 85 travels in groove 88 of a guide member 90 fixedly secured to a bracket 93 (see FIG. 4). The major portion of the groove 88 consists of a straight slot section 92 at its upstream end, while the minor portion of the groove 88 concludes at its downstream end with an angled slot section 94 whose axis is oriented at an angle of about 50 to 70 degrees with the axis of the straight slot section 92. The purpose of the angled slot section 94 will be discussed in greater detail hereinbelow.

The operation of the insertion station 20 will now be described. The envelope feed rollers 28 and 30 cooperate to feed an envelope from the position occupied by envelope 24*b* (see FIG. 9) to the position occupied by envelope 24*a* against the envelope stop 54 in the down position. The drive rollers 44, 46, 48 and 50 are lowered from the feed rollers 36, 38, 40 and 42 respectively, just before the envelope strikes the stop 54. The hold-down fingers 60 and 62 are in a raised position to allow the envelope to pass thereunder, and the flippers 68 and 70 are in a position where their interior ends respectively are raised. The waiting envelope at the insertion station is supported in a substantially horizontal orientation on the upper surface of conveyor 350.

Figure 12:
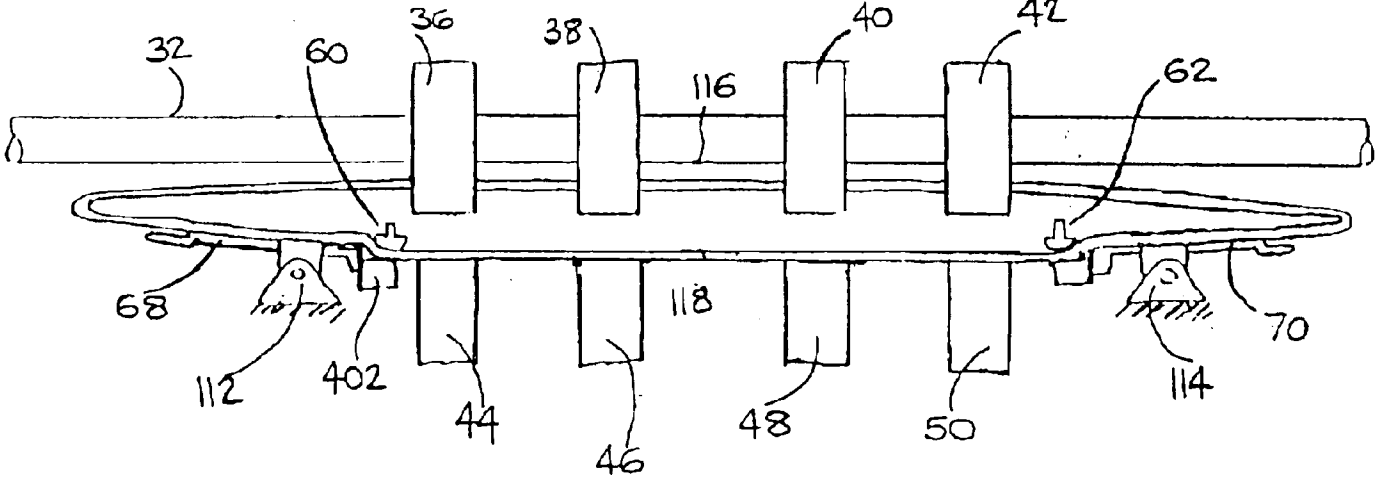
FIG. 12 is a sectional view taken on the plane indicated by the line 12—12 in FIG. 11.

Once the envelope has reached the position of the envelope 24*a*, the hold-down fingers 60 and 62 are rotated downward to the positions seen in FIGS. 6, 11 and 12 against the flippers 68 and 70 respectively, which are thereby caused to pivot against the bias of their torsion springs and pucker the envelope 24*a*, i.e. the envelope front panel 118 (address bearing panel) is separated from the back panel 116 (see FIG. 11). In this way, the flap 64 is forced downward and the envelope 24*a* is puckered, causing it to open.

It is to be noted that the envelope is opened by the combined action of firstly the step-like deformation to the envelope flap produced by the interaction between the flipper steps 68*e*, 70*e* and the hold-down fingers 60, 62, and secondly the deflection to the portion of the envelope flap located outboard of the corresponding finger 60,62 and in contact with the inboard and outboard legs (68*c*, 68*d* of flipper 68), resulting from the pivoting of the flippers 68, 70 (FIG. 12). In this way, the envelope can reliably be opened without reverse throating of the envelope.

It is further to be noted that the hold-down fingers 60, 62 press the envelope flap 64*a* downwardly against the upper surfaces of drive rollers 44, 46, 48, 50, as shown in FIGS. 11 and 12, so as to arch the front panel of the envelope downwardly, across the upper surface of bending roll 52. This arching helps to ensure that the front and rear envelope panels separate and that the rear panel pops upwardly rather than downwardly.

Figure 13:
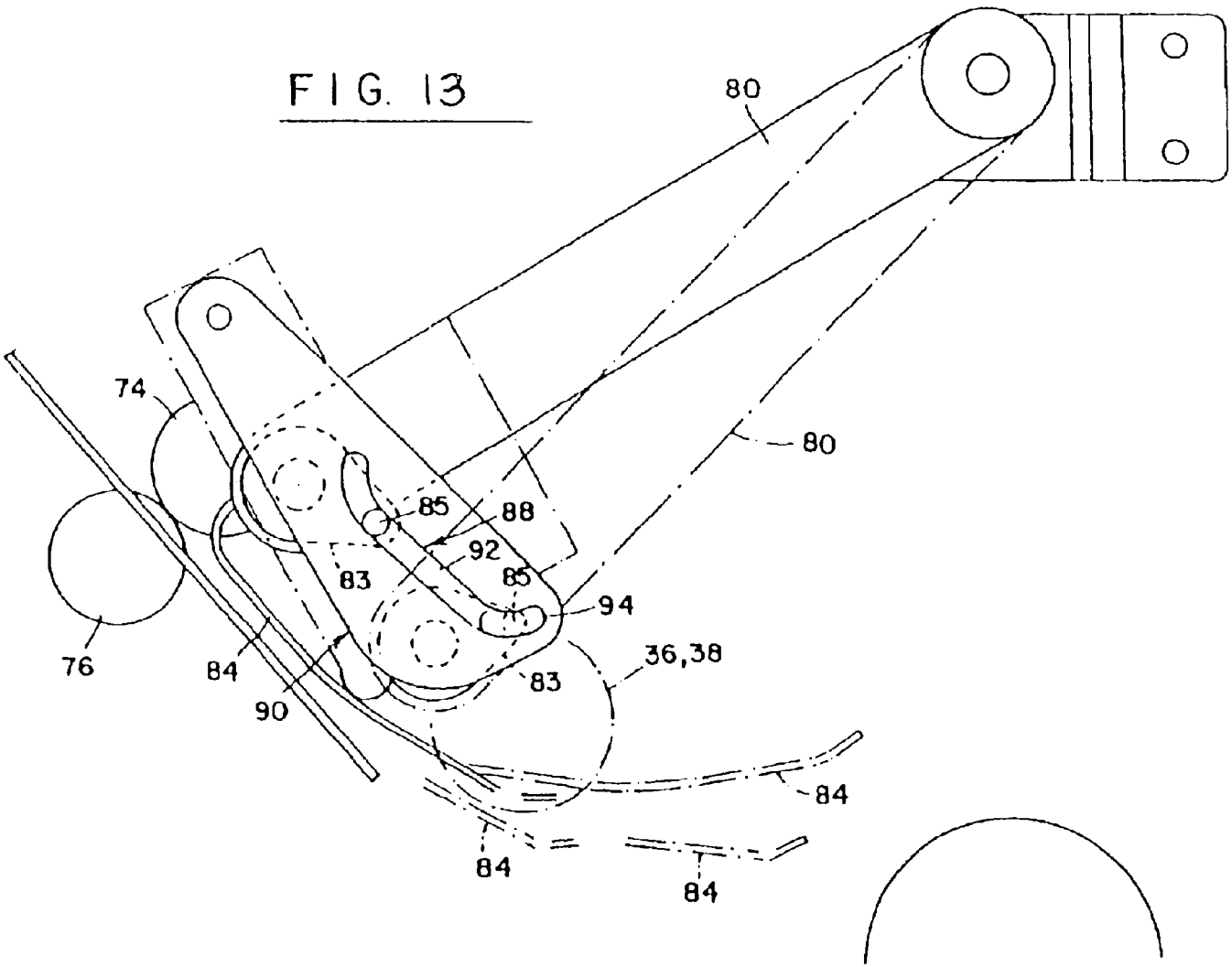
FIG. 13 is a side, elevational view of the opening horns and associated drive at the beginning and end of their cycle.
Figure 14:
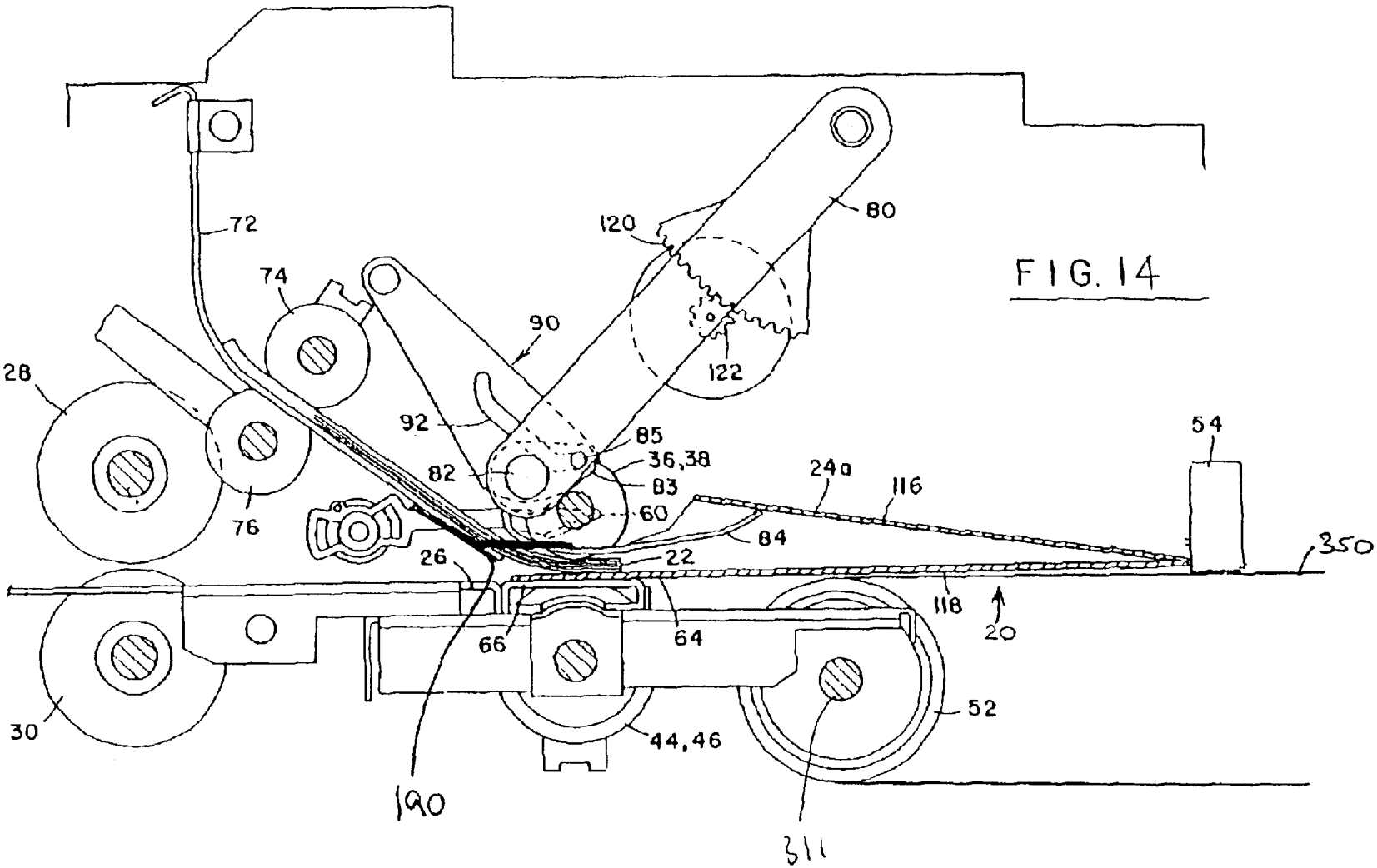
FIG. 14 is similar to FIG. 11 but shows the opening horns at the end of their cycle and the envelope fully opened with enclosure documents starting to be inserted into the fully opened envelope.

Additional separation of the envelope panels 116 and 118 is effected by the opening horns 84 and 86. Once the envelope panels 116 and 118 attain the position seen in FIG. 7, the pivotable supports 80 are rotated about 38 degrees counter-clockwise by a rack 120 and pinion gear 122 from the position seen in FIG. 11 to the position seen in FIG. 14. The counter-clockwise rotation of the supports 80 causes the shaft 82 to move the link members 83 counter-clockwise which drives the pins 85 down the grooves 88 in the straight slot sections 92 and then up into the angled slot sections 94. The result of the pins 85 traversing the full length of the grooves 88 is that the shaft 82 follows the pins 85 without rotating on its own axis while the pins 85 are in the straight slot sections 92, but when the pins 85 enter the angled slot sections 94 the shaft 82 is caused to rotate about its own axis counter-clockwise. Since the opening horns 84 and 86 are fixedly secured to the shaft 82, the horns 84 and 86 are caused to rotate counter-clockwise about the axis of the shaft 82, as seen in FIG. 13. The result of the rotation of the horns 84 and 86 on the back panel 116 is seen in FIG. 14, i.e. the back panel 116 is raised further upwardly to virtually guarantee that the enclosure documents 22 have free entry into the envelope 24*a*. The path of travel of the horns 84 and 86 causes the horns 84 and 86 to be dropped onto the open flap 64. The first contact point is before the smallest throat of the smallest envelope to be handled. The horns 84 and 86 then are caused to slide down the inside back surface of the envelope, i.e. the flap 64 and the front panel 118, until the horns 84 and 86 have passed beyond the deepest throat opening to be handled. The horns 84 and 86 are then caused to be raised until the envelope 24*a* is positively opened, as seen in FIG. 14.

While the envelope 24*a* is being opened as described hereinabove, the enclosure documents 22 are being fed along the chute 72 toward the insert feed rollers 74 and 76 which convey the documents 22 to the feed rollers 36, 38, 40 and 42. The leaf spring 190 holds the enclosure documents 22 in driving contact with the upper feed rollers 36, 38, 40 and 42, the lower drive rollers 44, 46, 48 and 50 being in their lowered position. Accordingly, the feed rollers 36, 38, 40 and 42 convey the enclosure documents 22 into the waiting envelope 24*a*, as seen in FIG. 14. The time for this insertion process to occur is approximately 400 to 500 milliseconds. The inboard friction pads on the flippers prevents the back panel of the envelope being pushed forward as the enclosure documents 22 are driven into the waiting envelope.

Figure 15:
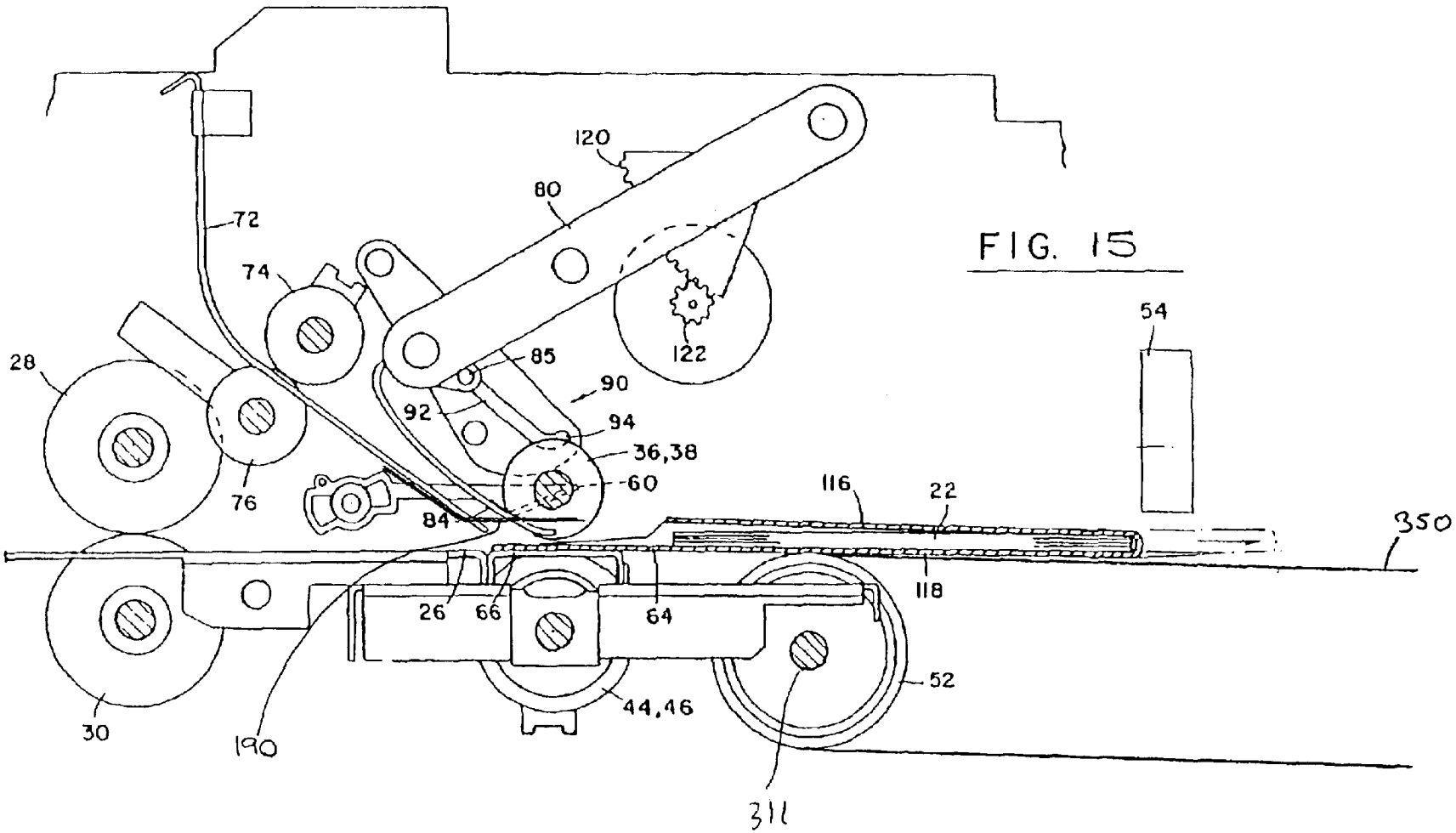
FIG. 15 is similar to FIG. 14 but shows the enclosure documents fully inserted in the envelope and the opening horns retracted from the envelope.

Once the documents are fully inserted as shown in FIG. 15, the horns 84,86 are retracted from the envelope. If desired, at this point a further folded document may be inserted by the steps of re-inserting the horns 84,86 beneath the first document or collation before feeding the next document or collation into the envelope and then retracting horns 84,86 again. If desired, this sequence may be repeated several times until the envelope is full.

The horns 84 and 86 are shaped so that they will pass under the shaft 32 on the outside of the rollers 36 and 42 (see FIG. 7), but close enough to the rollers 36 and 42 to be inside the smallest envelope to be handled. If desired, a third horn could be located on the centerline between the rollers 38 and 40.

Although the foregoing description shows a pair of pivotable supports 80 and associated linkage to the shaft 82, the envelope opening apparatus can function well with only a single support 80, a single link member 83, a single pin 85 and a single groove 88.

Once the envelope 24*a* has been filled with the documents 22, as seen in FIG. 11, the vertically translatable envelope stop 54 is caused to be raised (by means not shown). At the same time, both the hold down fingers and the lower rollers 44, 46, 48 and 50 are raised to release the filled envelope, which is transported from the insertion station 20 along the upper surface of the conveyor 350 to the moistener station 30, where moisture is applied to the envelope flap. As previously described, the envelope is held with flap closed for an adjustable time at the sealing station 252, before being advanced through the sealing rollers 264,265. After sealing, the envelope is conveyed along path 256 to exit the inserter into a collection bin or the like, diagrammatically shown at 259 in FIG. 1.

When the envelope is filled with multiple inserts, it may be understood that the strain on the sealed flap will increase. In general, the greater the thickness of the inserted group of documents, the greater the strain. It is accordingly desired to ensure that the sealed flap will adhere firmly and immediately to avoid bursting after the envelope has left the sealing station. By pausing the envelope for a short time interval following moistening, the adhesive is allowed to become thoroughly wetted and emulsified, which promotes better adhesion. Preferably the time interval is adjustable according to the number of individual documents making up the envelope contents.

Whilst reference is made hereinabove to stuffing an envelope with a collation, it will be appreciated that the inserter is versatile in operation and can be set so as to feed a single sheet, or a plurality of sheets, with or without folding, in each case with or without one or more inserts. Alternatively, the inserter can be used to place other documents, such as an insert or plurality of inserts only, within the envelope.

The way in which the adjustable time interval is achieved will now be described with reference to FIG. 16.

Briefly, the addition of a spring wrap clutch 310 allows the envelope travel to be interrupted or paused as it passes from moistener 30 to sealing rollers 264,265 at the sealer station 252. The period of delay is adjustable to optimize the time for the envelope adhesive to be water-activated.

Instead of a single belt drive linking the inserting station drive shaft 311 to the moistener station input drive shaft 319, the belt drive is split to enable an intermediate shaft 313 to be provided. The clutch 310 is mounted on the intermediate shaft 313. This permits the drive to belt 316 to remain constantly engaged.

The intermediate shaft 313 carries a double drive pulley 314*a*, 314*b* which is driven by the belt 316 from the shaft 311 and thus constantly rotates. The pulley 314*a*, 314*b* is mounted on shaft 313 by bearings in order to reduce direct or axial belt loading on the clutch 310. The output drum of the spring wrap clutch 310 is attached to the shaft 313, whilst the input drum is connected to the pulleys 314*a*, 314*b*. At the other end of the shaft 313 is fixedly mounted a drive pulley 315 which provides motion to the rollers 263,264 driven by shaft 312, via a belt drive 317. When the clutch 310 is electrically energized, drive to the shaft 313 is disengaged, thus preventing drive to the rollers 263,264 by stopping belt 317. By controlling the time interval for which the clutch is energized, the envelope dwell time is adjusted according to the predicted thickness of the envelope contents. Pulley 314*b* carries a further belt 318 which drives shaft 319 providing drive motion to the input rollers 261,262 of the moistener station 30. Belt 317 also drives a further shaft 320 which carries the output rollers 266.

As known to a person skilled in the art, the wrap spring clutch basically consists of a spring which is wrapped with a slight interference fit around two adjacent drums—the input drum and the output drum. By the addition of a radial tang on the input end of the spring, the clutch can be controlled. Normally, the input drum rotates continuously and drives the output drum by causing the spring to wrap into tight engagement. When the tang is arrested, the spring tends to unwrap and thus uncouples the clutch. The spring may be surrounded by a release collar which has a projecting lug on its outer diameter and an inner slot which engages the spring tang. The clutch may be electrically or hydraulically actuated.

Figure 16:
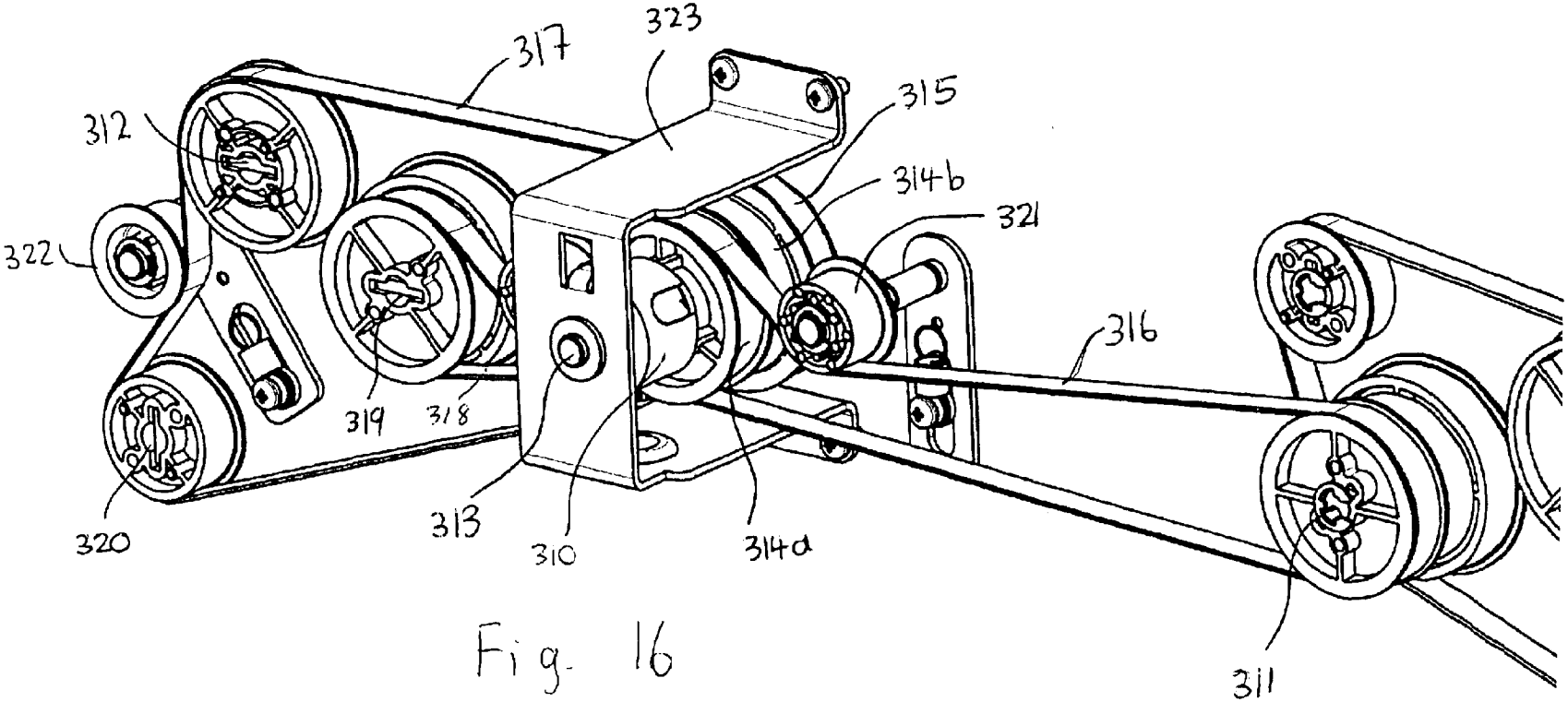
FIG. 16 shows a belt drive and clutch mechanism for the sealing station.
Figure 17:
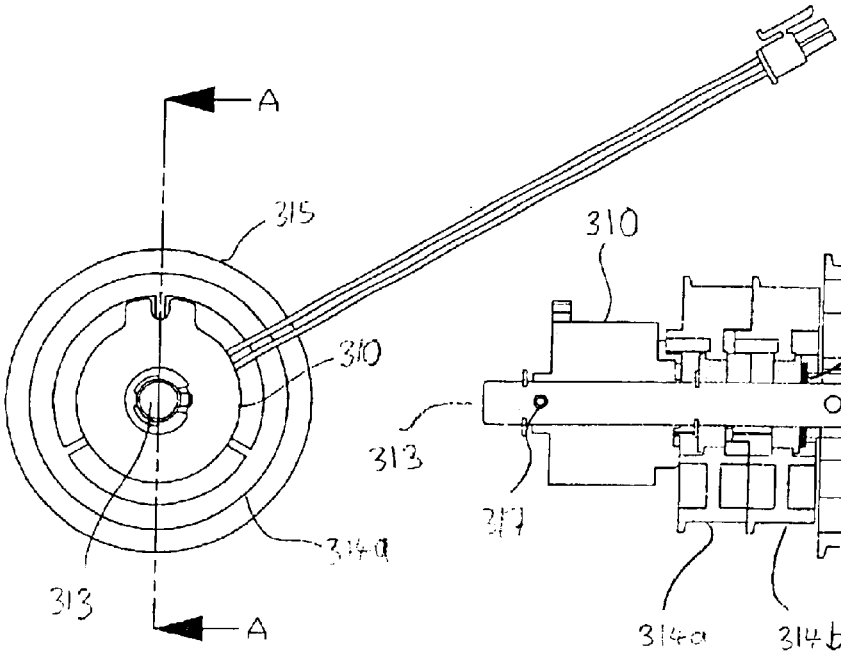
FIG. 17 shows the clutch mechanism in end view.
Figure 18:
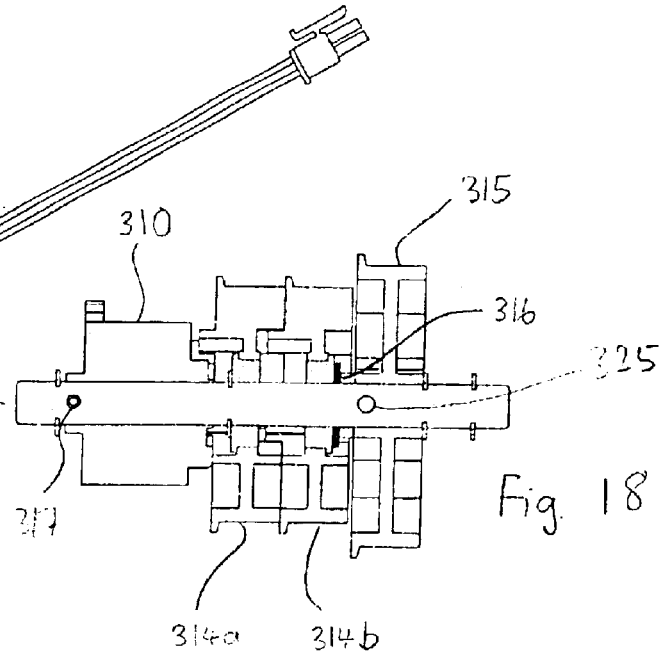
FIG. 18 shows a sectional view of the clutch mechanism taken on plane A—A of FIG. 17.
Figure 19:
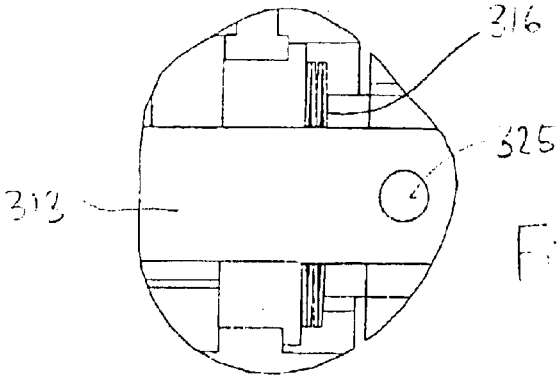
FIG. 19 shows a scrap view of the clutch mechanism of FIG. 18.

FIGS. 17, 18 and 19 show further details of the clutch 310 and pulleys 314*a*, 314*b* and 315 of FIG. 16. It may be seen that clutch 310 is pinned to shaft 313 at 317, whereas pulley 315 is pinned to shaft 313 at 325. Bias springs 316 bias the continuously rotating pulleys 314*a*, 314*b* away from the end pulley 315.

It may be noted that the maximum envelope dwell time is normally designed to be 5 seconds. In practice, it is found experimentally that a dwell time of 2 seconds is required where the envelope contains 1 or 2 sheets, and a dwell time of 3 seconds is needed if the number of sheets is 3, 4 or 5 (the normal design maximum). In special cases, a different dwell time may be customized by a service engineer.

It should also be noted that the problem of envelope bursting is especially acute where multiple documents are inserted singly into the envelope, because the documents tend to form a stack with a vertical edge in these circumstances leading to greater bulging at the envelope edge.

In contrast, where multiple documents are folded together and inserted as a single unit or collation, the documents tend to form a stack with a sloping edge, exerting less strain on the envelope edge. Nevertheless, the invention is naturally still applicable and is effective in reducing the tendency for sealed envelopes to burst open.

To determine the number of documents inserted in the envelope, in order to set the dwell time, the control system may include an optical mark reader for reading an optical mark provided on each document, or on at least one document, indicating the number of items to be inserted. Alternatively, the control system may receive an input from an operator interface enabling an operator to set the number of items to be inserted in each envelope.

It should be understood by those skilled in the art that various modifications may be made in the present invention without departing from the spirit and scope thereof, as described in the specification and defined in the appended claims.

We claim:

1. An apparatus comprising a sealing apparatus for sealing a stuffed envelope having a moisture-activated adhesive on its flap, including a moistener for wetting the moisture-activated adhesive on the envelope flap, a sealer for applying the envelope flap to the stuffed envelope body to seal the same and a control system for arresting the moistened envelope for a dwell time before the sealing operation, and means for determining the number of items to be inserted in each envelope and means for setting said dwell time according to the determined number of items wherein the number determining means comprises an optical mark reader for reading an optical mark on each item indicating the number of items to be inserted in the envelope.

2. An apparatus according to claim 1, wherein a motor drive arrangement is provided for driving the stuffed envelope from the moistener through the sealer and the control system comprises a clutch operative to declutch drive from the motor drive arrangement to the stuffed envelope.

3. An apparatus according to claim 1, wherein the control system is arranged to arrest the envelope with its flap closed.

4. An apparatus according to claim 1, wherein the control system is arranged to arrest the envelope with its flap open.

5. An apparatus according to claim 1 further comprising:

a feeder for feeding documents to an envelope stuffing station for insertion into an envelope; and said sealing apparatus arranged to receive a stuffed envelope from the stuffing station and to seal the envelope flap.

6. An apparatus according to claim 1, wherein the number determining means comprises an operator interface for enabling an operator to set the number of items to be inserted in each envelope.

* * * * *